US009845657B2

(12) United States Patent
Hibberd

(10) Patent No.: US 9,845,657 B2
(45) Date of Patent: Dec. 19, 2017

(54) SEAL SLEEVE AND ASSEMBLY INCLUDING SUCH A SEAL SLEEVE

(71) Applicant: Ruma Products Holding B.V., Hoogeveen (NL)

(72) Inventor: Roger Wilfred Hibberd, Hoogeveen (NL)

(73) Assignee: RUMA PRODUCTS HOLDING B.V., Hoogeveen (NL)

( * ) Notice: Subject to any disclaimer, the term of this patent is extended or adjusted under 35 U.S.C. 154(b) by 568 days.

(21) Appl. No.: 14/358,750

(22) PCT Filed: Nov. 19, 2012

(86) PCT No.: PCT/NL2012/050820

§ 371 (c)(1),
(2) Date: May 16, 2014

(87) PCT Pub. No.: WO2013/095098

PCT Pub. Date: Jun. 27, 2013

(65) Prior Publication Data

US 2014/0306406 A1 Oct. 16, 2014

Related U.S. Application Data

(60) Provisional application No. 61/566,050, filed on Dec. 2, 2011.

(30) Foreign Application Priority Data

Nov. 18, 2011 (NL) ..... 2007812
Nov. 30, 2011 (NL) ..... 2007896

(51) Int. Cl.
*E21B 33/12* (2006.01)
*E21B 33/00* (2006.01)

(52) U.S. Cl.
CPC ..... *E21B 33/1208* (2013.01); *E21B 33/1216* (2013.01); *E21B 2033/005* (2013.01)

(58) Field of Classification Search
CPC ..... E21B 33/1208; E21B 33/1216; E21B 2033/005
See application file for complete search history.

(56) References Cited

U.S. PATENT DOCUMENTS 3,385,367 A * 5/1968 Kollsman ..... E21B 33/1208 166/191
4,862,967 A * 9/1989 Harris ..... E21B 33/1208 166/179

(Continued)

FOREIGN PATENT DOCUMENTS

WO 2009/027658 A1 3/2009
WO 2009/098465 8/2009

OTHER PUBLICATIONS

Schlumberger Oilfield Glossary entries for: "cased hole"; "casing"; "hydrocarbon"; "production string"; "petroleum"; and "water production". Accessed Dec. 11, 2016 via www.glossary.oilfield.slb.com.*

*Primary Examiner* — Blake E Michener
(74) *Attorney, Agent, or Firm* — Jackson Walker LLP

(57) ABSTRACT

Seal sleeve and assembly including such a seal sleeve. A seal sleeve (10) having a seal sleeve wall (14) comprising a swellable polymer material having elastomeric properties so that the seal sleeve has non-swollen state and an expanded state, wherein the seal sleeve wall has a closed circumference that extends around a central longitudinal axis (A), the seal sleeve wall having a non-swollen thickness that is defined by the distance between an inner surface and an outer surface of the seal sleeve wall in the non-swollen state, the non-swollen thickness being less than the radial width of a circumferential space between an inner and an outer (Continued)

element that has to be closed off by the seal sleeve, wherein at least one of the end surfaces (14*a*, 14*b*, 252) extends in a plane that includes a sharp angle (a) with the longitudinal axis.

16 Claims, 8 Drawing Sheets

(56) References Cited

U.S. PATENT DOCUMENTS 7,296,597 B1 11/2007 Freyer et al.
7,814,973 B2 * 10/2010 Dusterhoft ..... E21B 47/01 166/227
8,201,636 B2 * 6/2012 Gandikota ..... E21B 33/1208 166/206
8,342,239 B2 * 1/2013 Kutac ..... E21B 33/1216 166/179
8,997,854 B2 * 4/2015 Lembcke ..... E21B 33/1208 166/134
9,303,483 B2 * 4/2016 Chalker ..... E21B 33/1208
2004/0194971 A1 * 10/2004 Thomson ..... E21B 33/14 166/387
2005/0000697 A1 * 1/2005 Abercrombie Simpson ..... E21B 17/22 166/380
2006/0272806 A1 * 12/2006 Wilkie ..... E21B 33/1208 166/192
2007/0056735 A1 3/2007 Bosma et al.
2007/0125532 A1 * 6/2007 Murray ..... E21B 33/1216 166/179
2007/0151724 A1 * 7/2007 Ohmer ..... E21B 33/1208 166/187
2007/0163777 A1 * 7/2007 Murray ..... E21B 33/1216 166/179
2008/0041577 A1 * 2/2008 Baaijens ..... E21B 43/08 166/74
2008/0093086 A1 * 4/2008 Courville ..... E21B 19/22 166/378
2008/0110626 A1 * 5/2008 Allison ..... E21B 23/06 166/288
2008/0121390 A1 * 5/2008 O'Malley ..... E21B 43/108 166/207
2009/0139707 A1 * 6/2009 Berzin ..... E21B 33/1208 166/118
2009/0200043 A1 8/2009 Olinger
2009/0283254 A1 * 11/2009 Andersen ..... E21B 17/023 166/118
2010/0038074 A1 * 2/2010 Patel ..... E21B 33/1216 166/187
2010/0139929 A1 6/2010 Rytlewski et al.

* cited by examiner

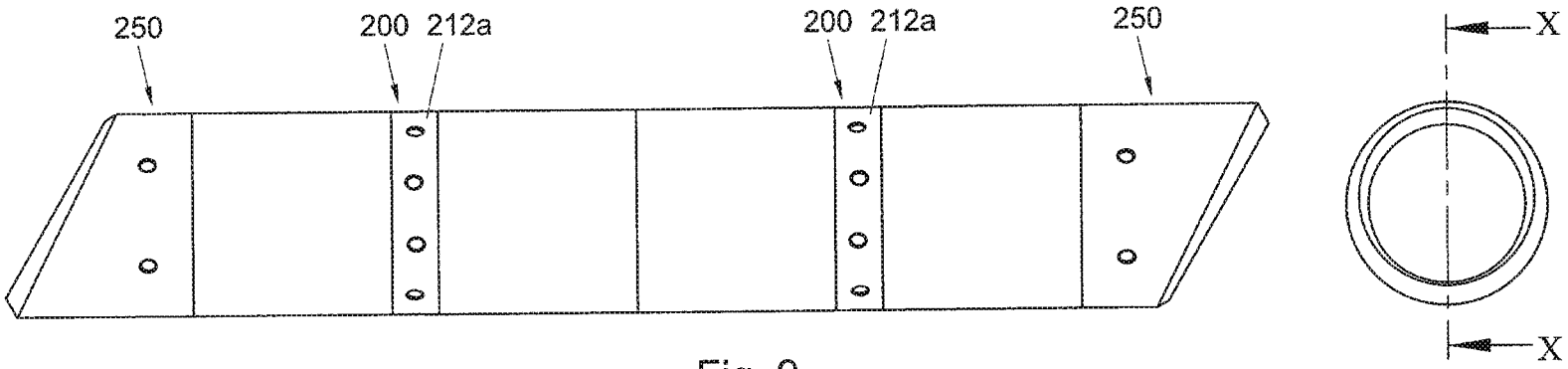
Fig. 9
Fig. 11
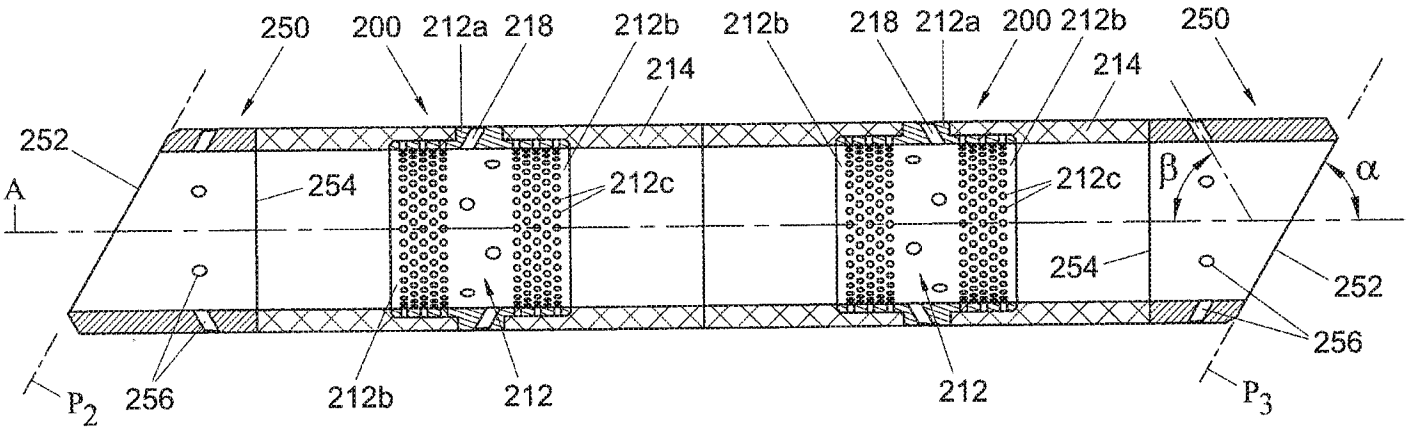
Fig. 10

SEAL SLEEVE AND ASSEMBLY INCLUDING SUCH A SEAL SLEEVE

TECHNICAL FIELD

The invention relates to a seal sleeve having a seal sleeve wall that includes swellable polymer material, to an assembly including such a seal sleeve and to a method for applying a seal sleeve between an inner element and an outer element.

BACKGROUND

A swelling seal sleeve is known from e.g. WO03/008756, WO06/003113 and US2007/0056735. In all these publications the seal sleeves disclosed therein are annular objects with a swelling seal sleeve wall with a radial wall thickness in a non-swollen state and an increased radial wall thickness in a swollen state. In general, these swelling seal sleeves may be mounted on an inner element having an outer surface that has to be introduced into an outer element having an inner surface. The inner element may, for example, be production tubing that has to be introduced into a bore well hole. In that example, the bore well hole or the casing thereof is the outer element.

SUMMARY OF THE INVENTION

In a first aspect, the invention is directed to a seal sleeve that can be more easily introduced in an outer element having an inner surface with cross sectional dimensions that are only slightly larger than the cross sectional dimensions of the seal sleeve.

To that end the invention provides a seal sleeve including:

a seal sleeve wall comprising a swellable polymer material having elastomeric properties so that the seal sleeve has non-swollen state and an expanded state, the seal sleeve wall having a closed circumference that extends around a central longitudinal axis and that has a certain length in the direction of the central axis;

the seal sleeve wall having a non-swollen thickness that is defined by the distance between an inner surface and an outer surface of the seal sleeve wall in the non-swollen state and having an expanded thickness that is defined by the distance between the inner surface and the outer surface of the seal sleeve wall in the expanded state; and two free end surfaces;

the seal sleeve being characterized in that the at least one of the end surfaces extends in a plane that includes a sharp angle with the longitudinal axis.

Such a seal sleeve may be applied for use in an assembly that includes an inner element having an outer surface and an outer element with a hole having an inner surface. The inner element being receivable within the outer element so that a circumferential space is present that extends in the longitudinal direction and that has a radial width defined by the distance between the outer surface of the inner element and the inner surface of the outer element. The seal sleeve is configured to close off the circumferential space in the expanded state thereof. In the non-swollen state the seal sleeve has a radial width that is less than the radial width of the circumferential space. The end surface that extends in a plane that includes a sharp angle with the longitudinal axis is more easily introduced into the hole in the outer element. In the prior art seal sleeves the free ends of the seal sleeve wall each extend in a plane associated with that free end that extends perpendicular to the longitudinal axis of the seal sleeve. When an irregularity is present in the inner wall of the outer element that bounds the hole, the free end of the prior art sleeves may easily get obstructed or stuck thus preventing further introduction of the seal sleeve into the hole of the outer element. With the seal sleeve according to the invention, in having a free end that extends in a plane that includes a sharp angle with the longitudinal axis of the seal sleeve, the occurrence that an irregularity on the inner wall of the outer element leads to a obstruction or blocking of the inward movement of the inner element with the seal sleeve is reduced considerably. It should be noted that the term sleeve in this context does not limit the scope to seals that may be disassembled from in inner element and thus be made slideable relative to the inner element. Additionally, seal sleeves that are permanently connected, bonded to or even integrally formed on inner element are contemplated.

Preferably, the sharp angle is in the range of 15°-50°. With a sharp angle in that range, the occurrence of obstruction or blocking during the introduction is minimized and the strength of the distal end point defined by the slanted free end of the seal sleeve is still sufficient.

In an embodiment a first one of the free end surfaces may extend in a first plane that includes a first sharp angle with the longitudinal axis and wherein a second one of the free end surfaces may extend in a second plane that includes a second sharp angle with the longitudinal axis.

This embodiment has the advantage that it does not matter in which way the seal sleeve is mounted on the inner end. The first one of the free end may be directed upstream or, alternatively downstream when viewed in the direction of introduction. In either case, a slanted free end is available at the upstream end of the seal sleeve, thus providing an improved introduction of the seal sleeve in the hole of the outer element.

In an embodiment the first and the second sharp angle may be the same so that the first and the second plane are parallel.

In order to further improve the strength of the structure of the seal sleeve, in an embodiment, the seal sleeve may include a cylindrical core having a core wall that is stiff. The core may be a metal core or a rubber or plastic core with a high rigidity.

Such a core wall provides mechanical strength, stiffness to the seal sleeve and makes an easy and simple locking or mounting on an inner element possible. Additionally, the occurrence of extrusion of the seal sleeve may be reduced by virtue of the presence of the core.

In an embodiment, the core has two core end surfaces that are defined by the core wall and that are each associated with an associated end surface of the seal sleeve wall, wherein each core end surface extends in a plane that is parallel to the plane in which the associated end surface extends.

By virtue of the fact that the end surfaces of the core extend parallel to the free ends of the seal sleeve wall, the strength of the free ends of the seal sleeve wall is substantially constant over the entire circumference of the seal sleeve wall.

In an embodiment of the seal sleeve with a cylindrical core, the seal sleeve may have a seal sleeve wall that comprises a part that also extends at least partly at an inner surface of the cylindrical core. Such a construction may be advantageous for mounting the seal sleeve on an inner element, such as for example a metal pipe or tube. In the non-swollen state, the seal sleeve may be bonded to or slid over the metal pipe or tube and be fixed by one or more fixation methods including but not limited to screw or other fixation means such as chemical or mechanical bonding or a mechanical locking system. When the swellable material is brought into the expanded state, a hermetically closed seal between the cylindrical core and the inner element is automatically obtained due to the expansion of the seal sleeve wall part that extends at the inner surface of the cylindrical core.

In an embodiment, the seal sleeve may include threaded holes in which bolts may be screwed to provide a connection between the inner element and the seal sleeve.

In an embodiment, each threaded hole may extend along an associated screw axis that includes a sharp angle with the longitudinal axis of the seal sleeve. By virtue of the sharp angle between the screw and the outer wall of the inner element that is thus provided, an improved resistance against a relative sliding movement between the seal sleeve and the inner element may be provided.

In an embodiment, the seal sleeve may comprise an assembly including:

at least one sealing member that includes the seal sleeve wall of swellable polymer material; and at least one end member including the end surface that extends in a plane that includes a sharp angle with the longitudinal axis.

Preferably, the seal sleeve may include two end members between which the at least one sealing member is positioned when the assembly is mounted on an inner element.

The end members may, for example, be manufactured of metal, so that they are very durable and will not be damaged when an the inner element carrying the seal sleeve is introduced in a hole of an outer element, such as a wellbore hole.

When the seal sleeve includes more than one sealing member, the sealing members may have seal sleeve walls of different qualities of swellable polymer material. These different qualities may, in an embodiment, be made visible by different colours of the polymer material. Thus the selection of a desired combination of different sealing members may be made easy by selecting sealing members having a desired colour.

A further problem of the known swelling seal sleeves is that the effectiveness of the known seal sleeve is not always optimal. Extensive research and testing of applicant has revealed that this may be caused by the fact that the swelling seal sleeve wall in practice only swells sufficiently over a limited part of its total length. Thus, the length of the actual seal that is obtained is much smaller than the length of the swelling seal sleeve wall. As a consequence, the pressure difference over the seal sleeve that is needed to break the seal is much smaller than one would expect if the swelling seal sleeve wall would have expanded along its entire length. The phenomenon that the swelling seal sleeve expands optimally only over a limited length is probably caused by the fact that first the free ends of the swelling seal sleeve wall come into contact with the swelling inducing liquid or gas. Thus, the seal sleeve wall adjacent the free ends swells and shuts off the middle part of the seal sleeve wall for prolonged contact with the swelling inducing liquid or gas. Consequently, the middle part of the seal sleeve wall does not swell or only swells to a limited extend and, thus, will not or not optimally contribute to the formation of a seal.

A further problem of the prior art swelling seal sleeves is the introduction of the inner element with the seal sleeve into an outer element having a hole with a inner surface with cross sectional dimensions that are only slightly larger than the cross sectional dimensions of the seal sleeve. The introduction may, in particular, be problematic when distance along which the inner element with the seal sleeve has to be introduced into the outer element is large and/or when the hole extends along a torturous path.

In a second aspect, the invention is directed to a seal sleeve that alleviates that problem of the prior art.

More particularly, the invention is directed to a seal sleeve that has an improved sealing effectiveness and/or that can be more easily introduced in an outer element having an inner surface with cross sectional dimensions that are only slightly larger than the cross sectional dimensions of the seal sleeve.

To that end the invention provides a seal sleeve including:

a seal sleeve wall comprising a swellable polymer material having elastomeric properties so that the seal sleeve has non-swollen state and an expanded state, the seal sleeve wall having a closed circumference that extends around a central longitudinal axis and that has a certain length in the direction of the central axis;

the seal sleeve wall having, at a given longitudinal position, a non-swollen thickness that is defined by the distance between an inner surface and an outer surface of the seal sleeve wall in the non-swollen state and having, at a given longitudinal position, an expanded thickness that is defined by the distance between the inner surface and the outer surface of the seal sleeve wall in the expanded state; and two free end surfaces that define a central reference plane, which is positioned centrally between the two free end surfaces and extends perpendicularly to the central axis;

the seal sleeve being characterized in that the seal sleeve wall has an outer diameter that decreases in the direction of the central axis when viewed from the central reference plane to one of the free end surfaces.

Such a seal sleeve may be applied for use in an assembly that includes an inner element having an outer surface and an outer element with a hole having an inner surface. The inner element being receivable within the hole of the outer element so that a circumferential space is present that extends in the longitudinal direction and that has a radial width defined by the distance between the outer surface of the inner element and the inner surface of the outer element. The seal sleeve is configured to close off the circumferential space in the expanded state thereof. In the non-swollen state the seal sleeve has a radial width that is less than the radial width of the circumferential space.

By virtue of the fact that the seal sleeve wall has a larger diameter at parts that are closer to the central reference plane than nearer to the free end surfaces, after contacting swelling inducing liquid or gas, such as a watery fluid or oil, the seal sleeve wall will firstly form a seal adjacent the central reference plane. After some time, because of the larger radial width of the gap between the outer surface of the seal sleeve wall and the inner wall of the outer element, the parts of the seal sleeve wall that are more remote from the central reference plane will contact the inner wall of the outer element and thus form a seal. As a result, a seal will be formed along the entire length of the expanding seal sleeve wall. The chance that the above described phenomenon occurs—namely, that a part of the seal sleeve wall will not, or only partly expand because another part of the seal sleeve wall already has expanded to form a seal that prevents more centrally positioned parts of the seal sleeve wall to come into prolonged contact with swelling inducing liquids or gas—is minimized. Thus a seal with a length that is approximately equal to the length of the expanding seal sleeve wall is obtained. Due to its optimal length, a maximum pressure difference may be withstood by the seal. An additional advantage of a tapered seal sleeve wall is that the chance that the introduction of the seal sleeve into the hole of an outer element is obstructed thus preventing further introduction of the seal sleeve into the hole of the outer element is smaller than with a seal sleeve having a cylindrical outer surface.

It should be noted that the term sleeve in this context does not limit the scope to seals that may be disassembled from in inner element and thus be made slideable relative to the inner element. Additionally, seal sleeves that are permanently connected, bonded to or even integrally formed on inner element are contemplated.

In an embodiment, the seal sleeve wall may include a part that is tapered towards the free end surface that is closest to the tapered part so that the outer diameter continuously decreases when viewed from the central reference plane in the direction of the free end surface that is closest to the tapered part.

Such a tapered part—in most case two opposite tapered parts—has the advantage that a seal is gradually formed starting adjacent the central reference plane and continuing towards the respective free ends.

In an embodiment, the seal sleeve wall may have a stepped outer surface including at least two step parts, wherein a step part that is more remote from the central reference plane has diameter that is smaller than the diameter of a step part that is closer to the central reference plane.

With such a stepped configuration, a similar effect as described above can be obtained although the tapered configuration is preferred in view of the more gradual formation of the seal. A stepped configuration may have an advantage from a manufacturing point of view.

In a further elaboration of the stepped embodiment, at least one of the step parts may be tapered towards the closest free end surface so that the outer diameter continuously decreases when viewed from the central reference plane in the direction of the free end surface that is closest.

In an embodiment, the at least one part of the seal sleeve wall that is tapered may include a taper angle cp that is defined by the top angle of a cone in which the tapered sleeve wall part extends that is in the range of 3°-20°.

With a taper angle in that range, it has been established that, with the swelling speed that is generally present, a seal is formed along the entire length of the expanding seal sleeve wall in most conditions.

In an embodiment, at least one of the free end surfaces may extend in a plane that includes a sharp angle with the longitudinal axis.

The free end surface of the seal sleeve that extends in a plane that includes a sharp angle with the longitudinal axis is more easily introduced into the hole in the outer element. In the prior art seal sleeves the free ends of the seal sleeve wall each extend in a plane associated with that free end that extends perpendicular to the longitudinal axis of the seal sleeve. When an irregularity is present in the inner wall of the outer element that bounds the hole, the free end of the prior art sleeves may easily get obstructed or stuck thus preventing further introduction of the seal sleeve into the hole of the outer element. With the seal sleeve having a free end that extends in a plane that includes a sharp angle with the longitudinal axis of the seal sleeve, the occurrence that an irregularity on the inner wall of the outer element leads to an obstruction or blocking of the inward movement of the inner element with the seal sleeve is reduced considerably.

Preferably, the sharp angle is in the range of 15°-50°. With a sharp angle in that range, the occurrence of obstruction or blocking during the introduction is minimized and the strength of the distal end point defined by the slanted free end of the seal sleeve is still sufficient.

In an embodiment both free end surfaces may extend in an associated plane, wherein the two planes are parallel.

This embodiment has the advantage that it does not matter in which way the seal sleeve is mounted on the inner element. The first one of the free ends may be directed upstream or, alternatively downstream when viewed in the direction of introduction. In either case, a slanted free end is available at the upstream end of the seal sleeve, thus providing an improved introduction of the seal sleeve in the hole of the outer element.

In an alternative embodiment the slanted free end surfaces may extend in non parallel planes that each include a sharp angle with the longitudinal axis.

In order to further improve the strength of the structure of the seal sleeve, in an embodiment, the seal sleeve may include a cylindrical core having a core wall that is stiff. The core may be a metal core or a rubber or plastic core with a high rigidity.

Such a core wall provides mechanical strength, stiffness to the seal sleeve and makes an easy and simple locking or mounting on an inner element possible. Additionally, the occurrence of extrusion of the seal sleeve may be reduced by virtue of the presence of the core.

In an embodiment, the core has two core end surfaces that are defined by the core wall and that are each associated with an associated free end surface of the seal sleeve wall, wherein each core end surface extends in a plane that is parallel to the plane in which the associated free end surface of the seal sleeve wall extends.

By virtue of the fact that the end surfaces of the core extend parallel to the free ends of the seal sleeve wall, the strength of the free ends of the seal sleeve wall is substantially constant over the entire circumference of the seal sleeve wall.

In an embodiment of the seal sleeve with a cylindrical core, the seal sleeve may have a seal sleeve wall that comprises a part that also extends at least partly at an inner surface of the cylindrical core. Such a construction may be advantageous for mounting the seal sleeve on an inner element, such as for example a metal pipe or tube. In the non-swollen state, the seal sleeve may be bonded to or slid over the metal pipe or tube and be fixed by one or more fixation methods including but not limited to screw or other fixation means such as chemical or mechanical bonding or a mechanical locking system. When the swellable material is brought into the expanded state, a hermetically closed seal between the cylindrical core and the inner element is automatically obtained due to the expansion of the seal sleeve wall part that extends at the inner surface of the cylindrical core.

In an embodiment, the seal sleeve may include threaded holes in which bolts may be screwed to provide a connection between the inner element and the seal sleeve.

In an embodiment, each threaded hole may extend along an associated screw axis that includes a sharp angle with the longitudinal axis of the seal sleeve. By virtue of the sharp angle between the screw and the outer wall of the inner element that is thus provided, an improved resistance against a relative sliding movement between the seal sleeve and the inner element may be provided.

The invention also provides an assembly of a seal sleeve according to the invention and an inner element having an outer surface and an outer element having an inner surface, wherein the inner element is receivable within the outer element so that a circumferential space is present that extends in a longitudinal direction and that has a radial width defined by the distance between the outer surface of the inner element and the inner surface of the outer element.

In an embodiment, the inner element may be a casing and the outer element may be a well bore hole wall.

In yet another embodiment, the inner element may be a production tubular and the outer element may be a casing of casing string in a well bore hole.

The invention also provides a method for applying a seal sleeve between an inner element and an outer element. The method includes:

providing an outer element having inner surface;

providing an inner element having an outer surface, the dimension of the inner element relative to the outer element being such that the inner element is receivable in the outer element;

providing a seal sleeve according to the invention;

applying the seal sleeve over the inner element;

fixing the seal sleeve at a longitudinal position on the inner element;

introducing the inner element into the outer element; and providing a liquid that induces the swelling of the swellable polymer material of the seal sleeve wall.

The invention will be further elucidated with reference to five examples of embodiments that are shown in the drawings.

BRIEF DESCRIPTION OF THE DRAWINGS

FIG. 9 shows an elevation view of the example of FIG. 7;

FIG. 10 shows a side elevation view of FIG. 9;

FIG. 11 shows a cross sectional view over line X-X of FIG. 10;

DETAILED DESCRIPTION

Figure 1:
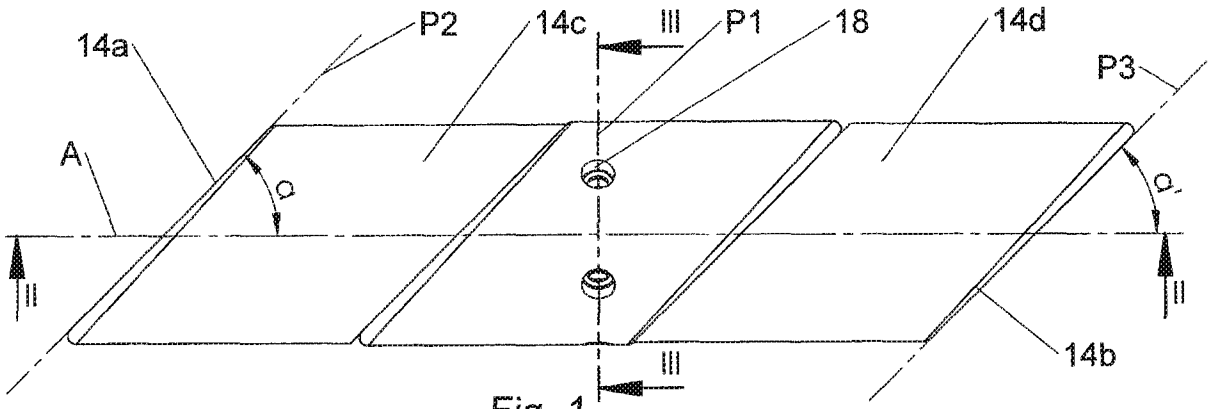
FIG. 1 shows an elevation view of an example of a first embodiment.
Figure 2:
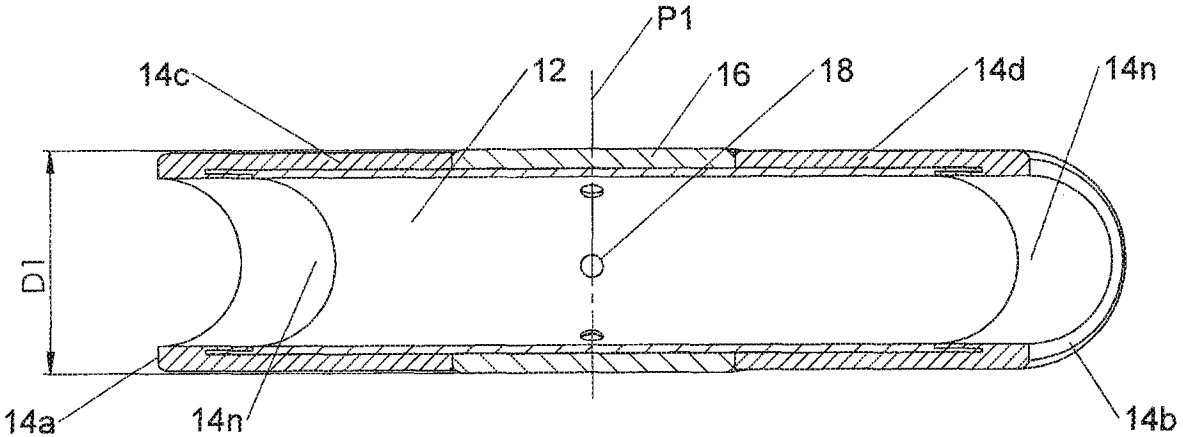
FIG. 2 shows a cross sectional view over line II-II of FIG. 1.
Figure 3:
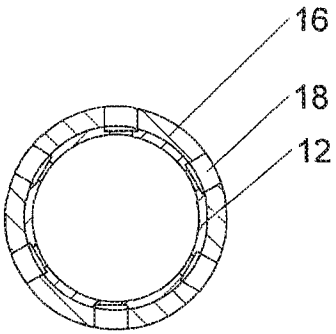
FIG. 3 shows a cross sectional view over line III-III of FIG. 1.

FIGS. 1-3 show an example of a first embodiment of a seal sleeve 10.

Figure 4:
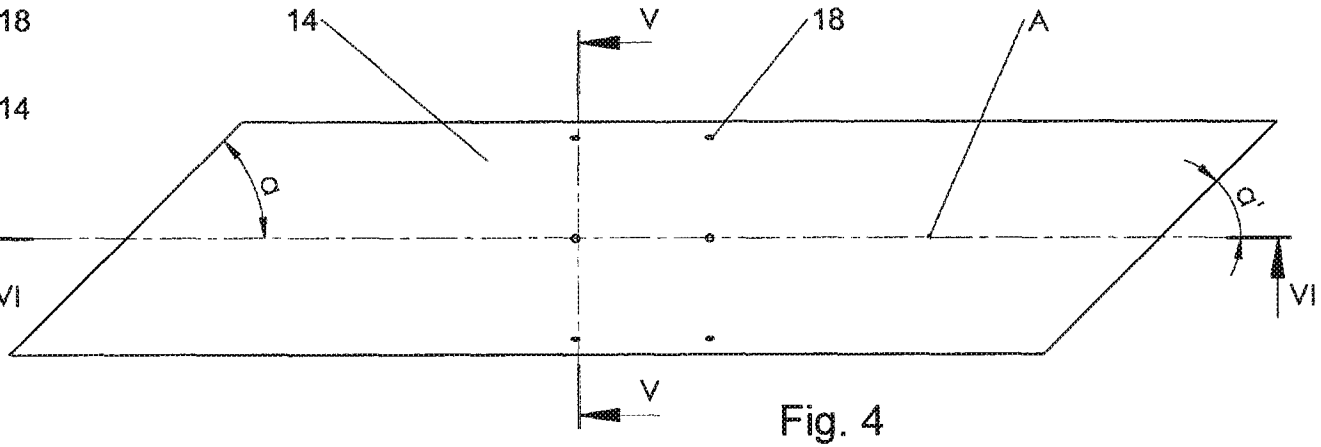
FIG. 4 shows an elevation view of an example of a second embodiment.
Figure 5:
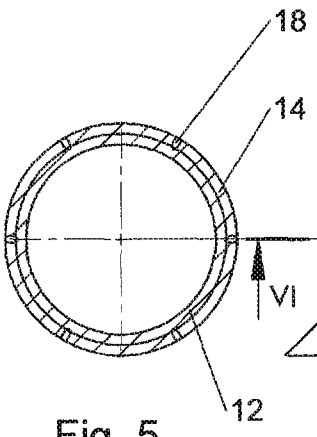
FIG. 5 shows a cross sectional view over line V-V of FIG. 4.
Figure 6:
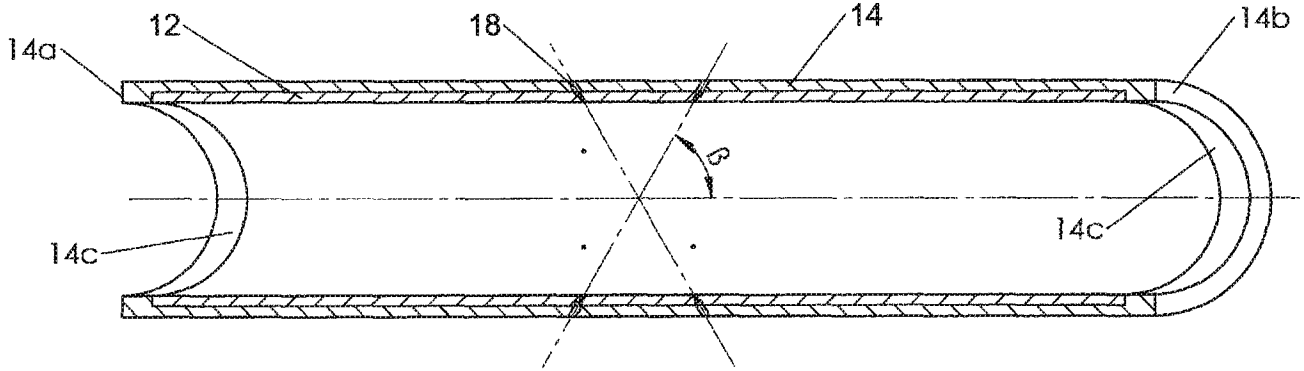
FIG. 6 shows a cross sectional view over line VI-VI of FIG. 5.
Figure 7:
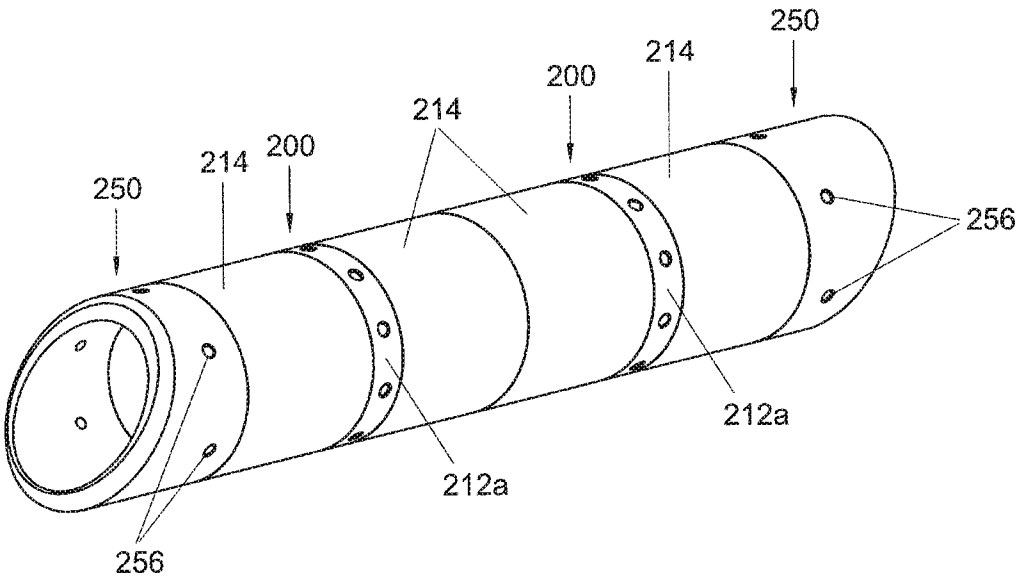
FIG. 7 shows a perspective view of an example of a third embodiment.
Figure 8:
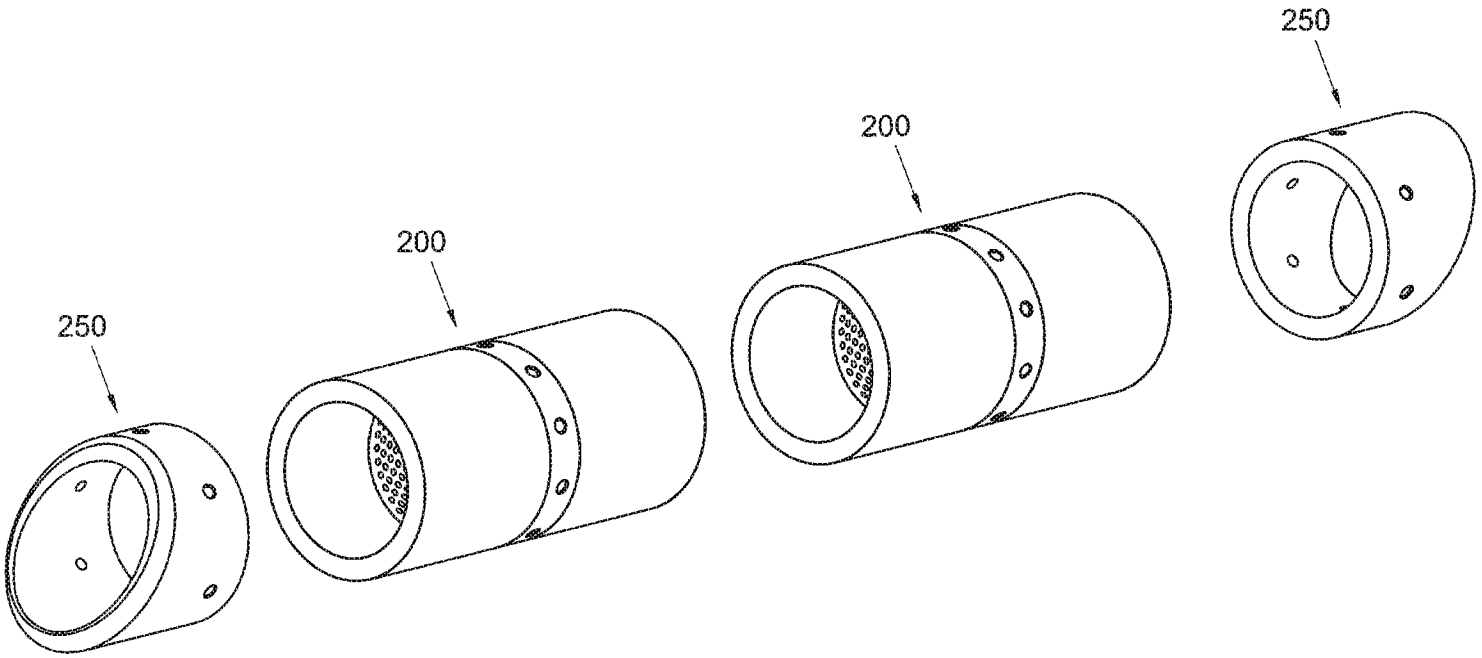
FIG. 8 shows an exploded view of the example of FIG. 7.

FIGS. 4-6 show an example of a second embodiment of a seal sleeve 10.

In general the disclosed seal sleeve 10 includes a seal sleeve wall 14 comprising a swellable polymer material having elastomeric properties so that the seal sleeve has non-swollen state and an expanded state. The seal sleeve wall 14 has a closed circumference that extends around a central longitudinal axis A and that has a certain length in the direction of the central axis A. The seal sleeve wall 14 has a non-swollen thickness that is defined by the distance between an inner surface and an outer surface of the seal sleeve wall 14 in the non-swollen state and has an expanded thickness that is defined by the distance between the inner surface and the outer surface of the seal sleeve wall 14 in the expanded state. The seal sleeve 10 has two free end surfaces that are defined by the seal sleeve wall 14. The seal sleeve 10 is characterized in that the at least one of the end surfaces 14*a*, 14*b* extends in a plane P2, P3 that includes a sharp angle $\alpha$ with the longitudinal axis A. By virtue of this sharp angle $\alpha$, introduction in a narrow hole of an outer element is easier and the chance that the seal sleeve 10 with that is mounted on an inner element 100 gets stuck in the hole in the outer element 110 is minimized.

This effect is further optimized when the sharp angle $\alpha$ is in the range of 15°-50°.

In an embodiment, of which the FIGS. 1-6 show two examples, a first one 14*a* of the free end surfaces 14*a*, 14*b* extends in a first plane P2 that includes a first sharp angle $\alpha$ with the longitudinal axis A and a second one 14*b* of the free end surfaces 14*a*, 14*b* extends in a second plane P3 that includes a second sharp angle $\alpha'$ with the longitudinal axis A. By virtue of the fact that both free end surfaces 14*a*, 14*b* are slanted, the manner in which the seal sleeve 10 is mounted on the inner element 100 does not effect the ease of introduction of the inner element 100 into the hole of the outer element 110. To further optimize this effect, the first and the second sharp angle $\alpha$, $\alpha'$ may in an embodiment be the same so that the first and the second plane P2, P3 are parallel.

In an embodiment, of which examples are shown in the FIGS. 1-6, the seal sleeve 10 may comprise a cylindrical core 12 that is stiff. In the examples that are shown in the figures, the cylindrical core 12 is provided at an inner side of the seal sleeve wall 14.

In an embodiment, of which the FIGS. 1-6 show two examples, the core 12 has two core end surfaces that are defined by the core wall and that are each associated with an associated free end surfaces 14*a*, 14*b* of the seal sleeve wall 14. Each core end surface may extend in a plane that is parallel to the plane P2, P3 in which the associated free end surface 14*a*, 14*b* of the seal sleeve wall 14 extends. Thus, a substantially uniform strength and stiffness of the free ends of the seal sleeve 10 along the circumference of the seal sleeve 10 is obtained.

In an embodiment of a seal sleeve 10 with a cylindrical core 12, a part 14*n* of the seal sleeve wall 14 may also extend at least partly at an inner surface of the cylindrical core 12. In such an embodiment, the cylindrical core 12 may be completely embedded in the seal sleeve wall 14 of swellable polymer material. Such an embodiment has the advantage of structural strength in combination with an easy mounting of the seal sleeve 10 on an inner element 100. The seal sleeve 10 may be shifted over the inner element 100 and may be temporarily fixed by fixing means such as a fixing screw, a wedge or glue. After swelling, the part of the seal sleeve wall 14 that is on the inside of the cylindrical core 18 expands against the inner element 100 and thus provides an excellent seal on that side as well.

In an embodiment, the seal sleeve may be provided with threaded holes 18 in which bolts may be screwed to provide a connection between an inner element 100 and the seal sleeve 10. These holes 18 may extend along a screw axis that is perpendicular to the longitudinal axis as shown in the example of FIGS. 1-3.

Alternatively, each threaded hole 18 may extend along an associated screw axis A2 that includes a sharp angle β with the longitudinal axis A of the seal sleeve wall 14 as shown in the example of FIGS. 4-6. Such an angled screw hole 18 has the advantage that an improved grip between the bolt that is screwed into the screw hole 18 and the inner element 100 may be obtained.

The example of the embodiment shown in FIGS. 1-3 differs from the example of the embodiment shown in FIGS. 4-6 in that the example of FIGS. 1-3 additionally includes a central cylindrical part 16 of non-swelling polymer material having an outer diameter D1 that is equal to or slightly larger than the outer diameter of the swelling seal sleeve wall 12. The non-swelling part 16 may be manufactured from a non swelling polymer material or from any other durable non-swelling material, for example, metal. The non-swelling part may be an integral part of the core 12. The non-swelling part 16 provides an additional advantage with respect to the introduction of the seal sleeve 10 in a hole of an outer element 110. By virtue of the larger diameter of the non-swelling part 16, it will be especially this part 16 of the seal sleeve that collides with the inner wall of the outer element 110 during introduction. This reduces the chance of damaging the seal sleeve wall 12 of the seal sleeve 10. In the illustrated example the non-swelling part 16 is a central part. It is also feasible that the seal sleeve 10 includes two non-swelling parts 16 at the free ends of the seal sleeve 10 and that the swelling seal wall 12 is a central part. To further optimize the ease of introduction of a seal sleeve 10 with a non-swelling part 16, it is advantageous when the free ends 16*a*, 16*b* of the non-swelling part 16 or parts 16 are slanted as well, i.e. extend in a plane that includes a sharp angle with the longitudinal axis A1. In an embodiment, this sharp angle is also typically in the range of 15°-50°.

FIGS. 7-11 show varies view of an example of a third embodiment. In this third embodiment the seal sleeve comprises an assembly including at least one sealing member 200 that includes the seal sleeve wall 214 of swellable polymer material. The assembly additionally includes at least one end member 250 including the end surface 252 that extends in a plane P2, P3 that includes a sharp angle α with the longitudinal axis A.

The end members 250 may, in an embodiment, be manufactured from a metal, such as, stainless steel.

In an embodiment, of which an example is shown in FIGS. 7-11, the seal sleeve assembly may include two end members 250 between which the at least one sealing member 200 is positioned when the assembly is mounted on an inner element 100. In the figures, the seal sleeve assembly includes two sealing members 200 that are positioned between two end members 250. More than two sealing members 200 or just one sealing member 200 is also feasible.

In an embodiment, of which an example is shown in FIGS. 7-11, the at least one sealing member 200 may have two opposite end surfaces that extend perpendicular to the longitudinal axis A. Each end member 250 may then have an end surface 254 that extends perpendicular to the longitudinal axis A, which perpendicular end surface is opposite to the end surface 252 that extends in a plane P2, P3 that includes a sharp angle α with the longitudinal axis A.

In yet another embodiment, of which an example is shown in FIGS. 7-11, the at least one sealing member may includes a substantial cylindrical core 212 having a central part 212*a* with an outer diameter that is substantially equal to an outer diameter of the seal sleeve wall 214 and that includes threaded holes 218 in which bolts may be screwed to provide a connection between an inner element 100 and the sealing member 200.

Such a core 212 provides a firm structural element to the sealing member 200, which facilitates the mounting of the sealing member 200 on an inner element 100 with the use of bolts. The core 212 may, for example, be manufactured from a metal, such as stainless steel.

In an embodiment, of which an example is shown in the figures, the cylindrical core 212 may have two outer parts 212*b* that extend axially away from the central part 212*a* along the longitudinal axis A. The seal sleeve wall 214 may be connected with the outer parts 212*b*. A firm connection between the seal sleeve wall 214 and the core 212 may be obtained when the two outer parts 212*b* include holes 212*c* in which the material of the seal sleeve wall 214 may extend.

In an embodiment, of which an example is shown in FIGS. 7-11, the at least one end member 250 may include threaded holes 256 in which bolts may be screwed to provide a connection between an inner element 100 and the end member 250. Preferably, each threaded hole 256 of the at least one end member 250 extends along a screw axis associated with that hole 256 which screw axis includes a sharp angle β with the longitudinal axis A of the seal sleeve wall 14, such that, when a bolt is tightened, the end member 250 is urged in a direction along the longitudinal axis A from the end surface that extends in a plane P2, P3 that includes a sharp angle α with the longitudinal axis A towards the opposite end surface of the end member 250. Thus by tightening the bolts in the threaded holes 256 of the end members 250, the end members 250 are urged towards the neighbouring sealing member 200 to form a seal sleeve without slits between the various members 200, 250 that constitute the seal sleeve.

Figure 12:
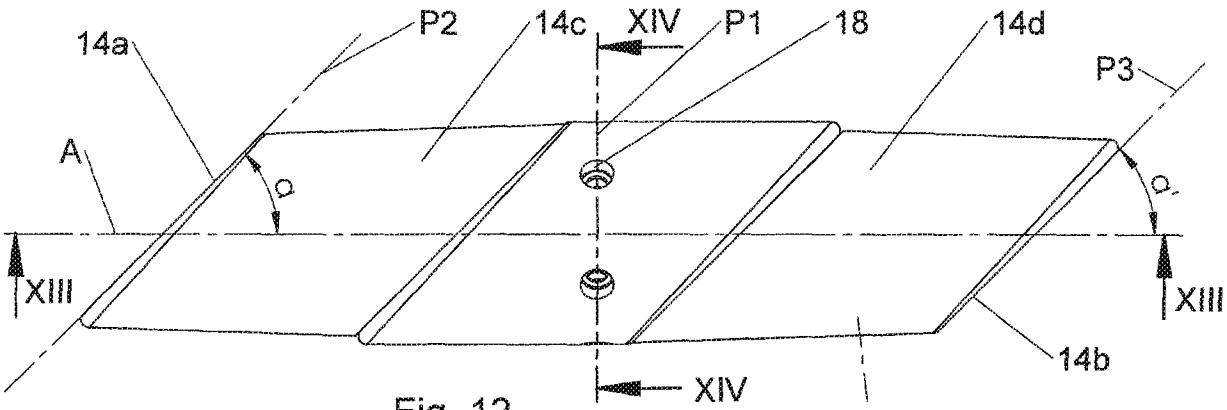
FIG. 12 shows an elevation view of an example of a fourth embodiment.
Figure 13:
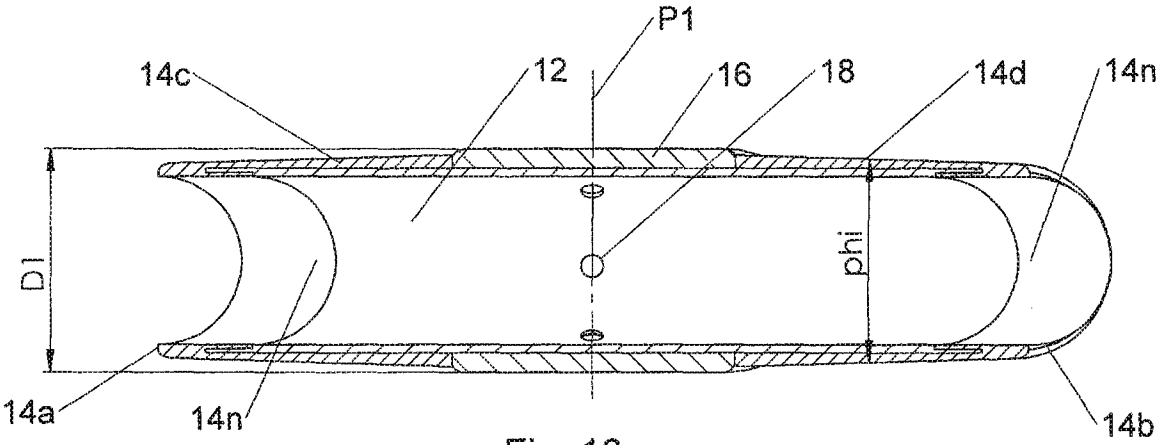
FIG. 13 shows a cross sectional view over line XIII-XIII of FIG. 12.
Figure 14:
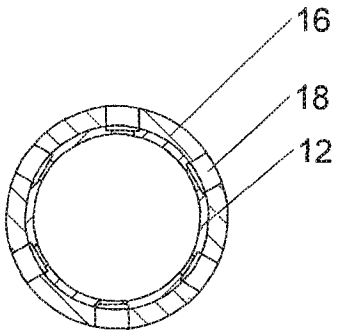
FIG. 14 shows a cross sectional view over line XIV-XIV of FIG. 12.

FIGS. 12-14 show an example of a fourth embodiment of a seal sleeve 10.

Figure 15:
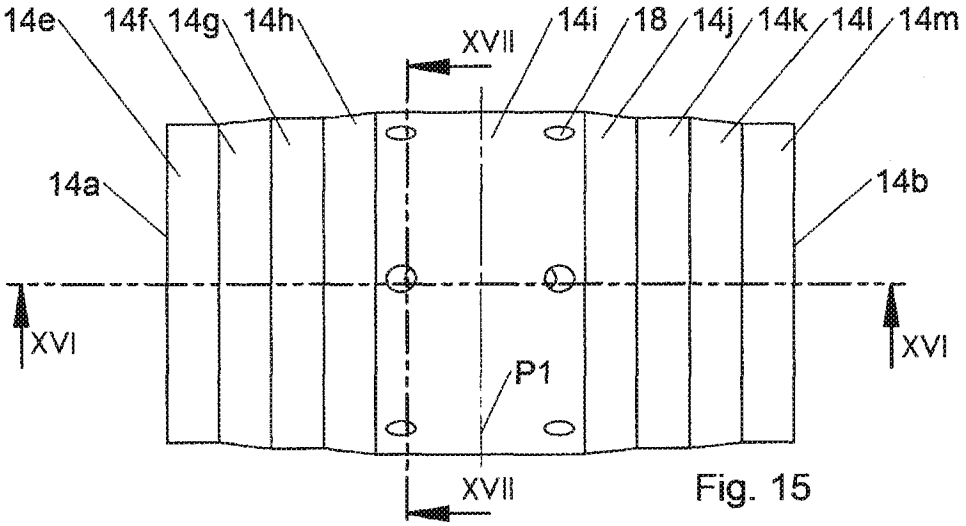
FIG. 15 shows an elevation view of an example of a fifth embodiment.
Figure 16:
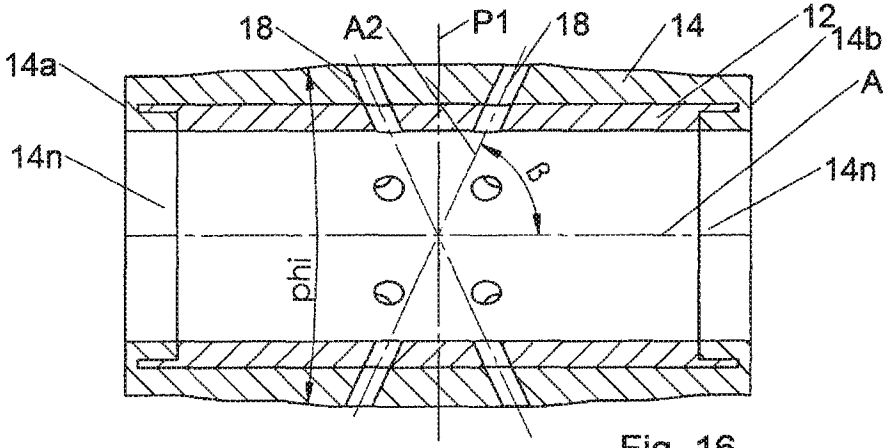
FIG. 16 shows a cross sectional view over line XVI-XVI of FIG. 15.
Figure 17:
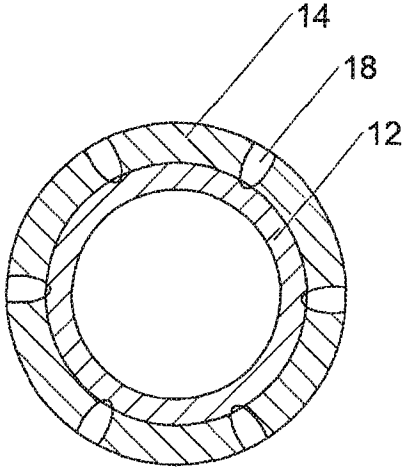
FIG. 17 shows a cross sectional view over line XVII-XVII of FIG. 15.

FIGS. 15-17 show an example of a fifth embodiment of a seal sleeve 10.

In general the seal sleeve 10 disclosed in FIGS. 12-17 includes a seal sleeve wall 14 comprising a swellable polymer material having elastomeric properties so that the seal sleeve has non-swollen state and an expanded state. The seal sleeve wall 14 has a closed circumference that extends around a central longitudinal axis A and that has a certain length in the direction of the central axis A. The seal sleeve wall 14 has, at a given longitudinal position, a non-swollen thickness that is defined by the distance between an inner surface and an outer surface of the seal sleeve wall 14 in the non-swollen state and has, at a given longitudinal position, an expanded thickness that is defined by the distance between the inner surface and the outer surface of the seal sleeve wall 14 in the expanded state. The seal sleeve 10 has two free end surfaces 14*a*, 14*b*. The two free end surfaces 14*a*, 14*b* define a central reference plane P1, which is positioned centrally between the two free end surfaces 14*a*, 14*b* and extends perpendicularly to the central axis A. In its most general aspect, the seal sleeve 10 is characterized in that the seal sleeve wall 14 has an outer diameter that decreases in the direction of the central axis A when viewed from the central reference plane P1 to one of the free end surfaces 14*a*, 14*b*.

Such a decreasing outer diameter to the effect that the outer diameter adjacent the free end surfaces 14*a*, 14*b* is smaller than the outer diameter adjacent the central reference plane P1 has the positive effect that formation of the seal due to the expansion of the seal sleeve wall 14 starts at the parts of the seal sleeve wall that are closest to the central reference plane P1 and in time gradually extends towards the free end surfaces 14*a*, 14*b*. Thus an effective seal is formed along the entire length of the seal sleeve wall 14. Consequently, the pressure difference that may be withstood over the seal is optimized by virtue of the fact that the length of the seal is substantially equal to the length of the seal sleeve wall 14. Additionally, the smaller diameter adjacent the free ends 14*a*, 14*b* promotes an easier introduction of a seal sleeve 10 in a narrow hole of an outer element.

In an embodiment, of which an example is shown in FIGS. 12-14, the seal sleeve wall 14 includes a part 14*c*, 14*d*—in the illustrated example, in fact, two parts are shown—that is tapered towards the free end surface 14*a*, 14*b* that is closest to the part so that the outer diameter continuously decreases when viewed from the central reference plane P1 in the direction of the free end surface 14*a*, 14*b* that is closest to the tapered part 14*c*, 14*d*.

In an alternative embodiment, of which an example is shown in FIGS. 15-17, the seal sleeve wall 14 may have a stepped outer surface including at least two step parts 14*e*-14*m*, wherein a step part 14*e*, 14*m* that is more remote from the central reference plane P1 has a diameter that is smaller than the diameter of a step part 14*f*-14*l* that is closer to the central reference plane P1.

In an embodiment, the step parts may have a constant diameter.

In alternative embodiment, of which an example is shown in FIGS. 15-17, at least one of the step parts 14*f*, 14*h*, 14*j*, 14*l* may be tapered towards the closest one of the free end surface 14*a*, 14*b* so that the outer diameter continuously decreases when viewed from the central reference plane P1 in the direction of the free end surface 14*a* or 14*b* that is closest.

In the embodiments having a tapered seal sleeve wall part 14*c*, 14*d*, 14*f*, 14*h*, 14*j*, 14*l*, it is preferred that the at least one part of the seal sleeve wall that is tapered includes a taper angle $\phi$ (phi), which is defined by the top angle of a cone in which the tapered sleeve wall part extends, that is in the range of 3°-20°.

With a taper angle $\phi$ in that range, optimal results are obtained in that under most circumstances a seal is formed that extends along the entire length of the seal sleeve wall 14.

In an embodiment, at least one of the free end surfaces 14*a*, 14*b* extends in a plane P2, P3 that includes a sharp angle $\alpha$, $\alpha'$ with the longitudinal axis A. By virtue of this sharp angle $\alpha$, $\alpha'$, introduction in a narrow hole of an outer element 110 is easier and the chance that the seal sleeve 10 that is mounted on an inner element 100 gets stuck in the hole in the outer element 110 is minimized.

This effect is further optimized when the sharp angle $\alpha$, $\alpha'$ is in the range of 15°-50°.

In an embodiment, of which the FIGS. 12-14 show an example, a first one 14*a* of the free end surfaces 14*a*, 14*b* extends in a first plane P2 that includes a first sharp angle $\alpha$ with the longitudinal axis A and a second one 14*b* of the free end surfaces 14*a*, 14*b* extends in a second plane P3 that includes a second sharp angle $\alpha'$ with the longitudinal axis A. By virtue of the fact that both free end surfaces 14*a*, 14*b* are slanted, the manner in which the seal sleeve 10 is mounted on the inner element 100 does not affect the ease of introduction of the inner element 100 into the hole of the outer element 110. To further optimize this effect, the first and the second sharp angle $\alpha$, $\alpha'$ may in an embodiment be the same so that the first and the second plane P2, P3 are parallel.

In an embodiment, of which examples are shown in FIGS. 12-17, the seal sleeve 10 may comprise a cylindrical core 12 that is stiff. In the examples that are shown in FIGS. 12-17, the cylindrical core 12 is provided at an inner side of the seal sleeve wall 14.

In an embodiment, of which FIGS. 12-17 show two examples, the core 12 has two core end surfaces that are defined by the core wall and that are each associated with an associated free end surface 14*a*, 14*b* of the seal sleeve wall 14. Each core end surface may extend in a plane that is parallel to the plane P2, P3 in which the associated free end surface 14*a*, 14*b* of the seal sleeve wall 14 extends. Thus, a substantially uniform strength and stiffness of the free ends of the seal sleeve 10 along the circumference of the seal sleeve 10 is obtained.

In an embodiment of a seal sleeve 10 with a cylindrical core 12, a part 14*n* of the seal sleeve wall 14 may also extend at least partly at an inner surface of the cylindrical core 12. In such an embodiment, the cylindrical core 12 may be partly or completely embedded in the seal sleeve wall 14 of swellable polymer material. Such an embodiment has the advantage of structural strength in combination with an easy mounting of the seal sleeve 10 on an inner element 100. The seal sleeve 10 may be shifted over the inner element 100 and may be temporarily fixed by fixing means such as a fixing screw, a wedge or glue. After swelling, the part 14*n* of the seal sleeve wall 14 that is on the inside of the cylindrical core 12 expands against the inner element 100 and thus provides an excellent seal on that side as well.

In an embodiment, the seal sleeve may be provided with threaded holes 18 in which bolts may be screwed to provide a connection between an inner element 100 and the seal sleeve 10. These holes 18 may extend along a screw axis that is perpendicular to the longitudinal axis as shown in the example of FIGS. 12-14.

Alternatively, each threaded hole 18 may extend along an associated screw axis A2 that includes a sharp angle $\beta$ with the longitudinal axis A of the seal sleeve wall 14 as shown in the example of FIGS. 15-17. Such an angled screw hole 18 has the advantage that an improved grip between the bolt that is screwed into the screw hole 18 and the inner element 100 may be obtained.

The example of the embodiment shown in FIGS. 12-14 differs from the example of the embodiment shown in FIGS. 15-17 in that the example of FIGS. 12-14 additionally includes a central cylindrical part 16 of non-swelling material having an outer diameter D1 that is equal to or slightly larger than the outer diameter of the swelling seal sleeve wall 12. The non-swelling part 16 may be manufactured from a non swelling polymer material or from any other durable non-swelling material, for example, metal. The non-swelling part may be an integral part of the core 12. The non-swelling part 16 with the slightly larger diameter provides an additional advantage with respect to the introduction of the seal sleeve 10 in a hole of an outer element 110. By virtue of the larger diameter D1 of the non-swelling part 16, it will be especially this part 16 of the seal sleeve 10 that collides with the inner wall of the outer element 110 during introduction. This reduces the chance of damaging the seal sleeve wall 12 of the seal sleeve 10. In the illustrated example the non-swelling part 16 is a central part. It is also feasible that the seal sleeve 10 includes two non-swelling parts 16 at the free ends 14*a*, 14*b* of the seal sleeve 10 and that the swelling seal wall 12 is a central part. To further optimize the ease of introduction of a seal sleeve 10 with a non-swelling part 16, it is advantageous when the free ends 16*a*, 16*b* of the non-swelling part 16 or parts 16 are slanted as well, i.e. extend in a plane that includes a sharp angle with the longitudinal axis A1. In an embodiment, this sharp angle is also typically in the range of 15°-50°.

Figure 18:
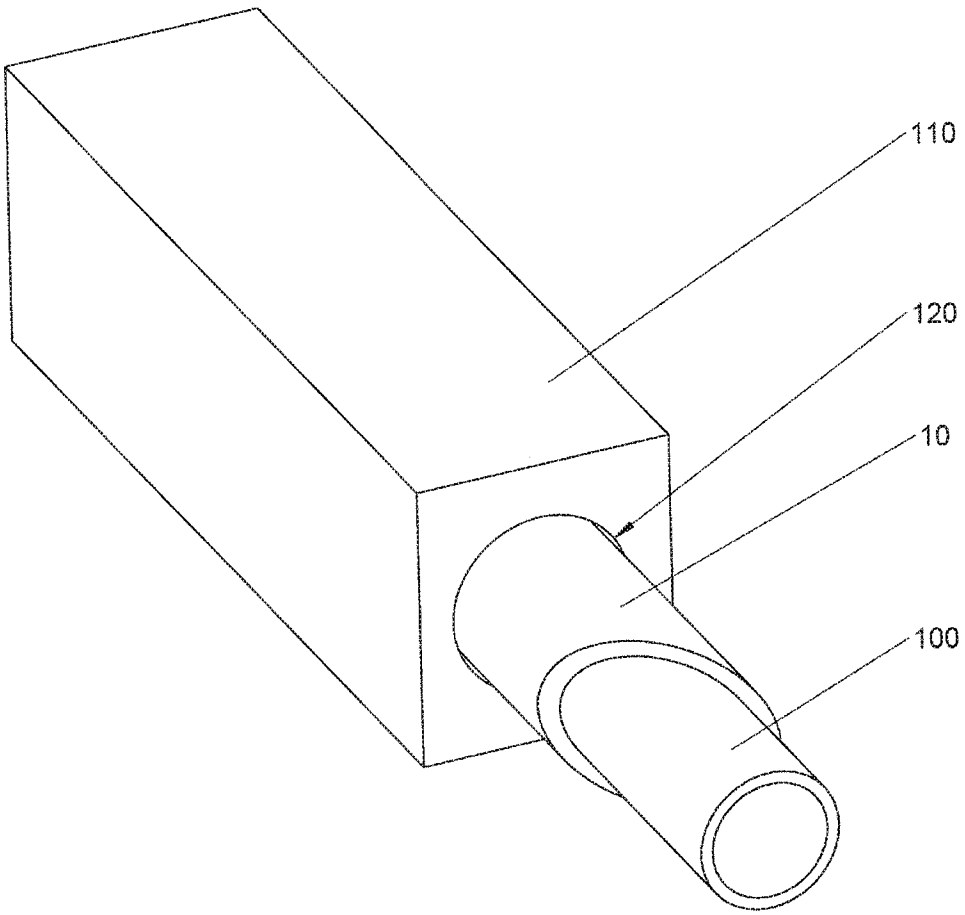
FIG. 18 shows a perspective view of an assembly of an inner element, an outer element and the example of the embodiment of FIGS. 4-6.

FIG. 18 shows an example of an assembly of a seal sleeve 10, an inner element 100 having an outer surface and an outer element 110 having an inner surface. The inner element 100 is receivable within a hole in the outer element 110 so that a circumferential space 120 is present that extends in a longitudinal direction and that has a radial width defined by the distance between the outer surface of the inner element 100 and the inner surface of the outer element 110. When the seal sleeve wall 14 is expanded, the circumferential space 120 is blocked by the expanded seal sleeve wall 14 so that a seal is obtained.

In an embodiment of the assembly, the inner element 100 may be a production tubular and the outer element 110 may be a casing in a well bore hole. The casing 110 extends in a bore hole in an earth layer.

In an another embodiment of the assembly, the inner element 100 may a casing of a casing string and the outer element 110 may be a well bore hole wall.

In yet another embodiment, the outer element 110 may be a housing of an apparatus and the inner element 100 may be a shaft that is mounted in the housing.

Suitable elastomers are rubber materials which, apart from swelling in watery fluids alternatively or additionally may swell in crude oil present in petroleum wells. Alternatively or additionally rubber materials may be used that swell in contact with certain gases. Watery fluids may be neutral, alkaline or acid fluids. Examples of suitable rubber materials are ethylene propylene rubber; ethylene-propylene-diene terpolymer rubber; butyl rubber; brominated butyl rubber; chlorinated butyl rubber; chlorinated polyethylene; neoprene rubber; epichlorohydrin ethylene oxide copolymer; styrene butadiene copolymer rubber; sulphonated polyethylene; ethylene acrylate rubber; silicone rubbers; and fluorsilicone rubber.

Also suitable are rubber materials which do not swell in crude oil, such as butadiene acrylonitrile copolymer (nitrile rubber, NBR); hydrogenated NBR, such as ZETPOL™, TORNAC™, TERBAN™; NBR with reactive groups; perfluoro rubbers such as KALREZ™, CHEMRAZ™; fluoro rubbers, such as VITON™, FLUOREL™; and tetrafluorethylene/propylene, such as AFLAS™.

Most of these elastomers can be crosslinked by more than one crosslinking agent (e.g. either sulphur crosslinked or peroxide crosslinked).

Apart from the thermoset (non swelling and oil swelling) elastomer matrix materials quoted above, also blends of elastomers can be applied (so called "elastomeric alloys"). Although an almost inexhaustible combination of thermoplastic and thermoset elastomers are feasible, the most preferred are the EPDM/polypropylene blends such as SARLINK™, Levaflex™, Santoprene™, NBR-polypropylene blends such as GEOLAST™, NBR/polyvinylchloride blends and NR/polypropylene blends. All of these have a tendency to swell in petroleum crudes, especially at the targeted downhole well temperatures.

In an application of the seal sleeve 10, the following method may be used:

- providing an outer element 110 having inner surface;
- providing an inner element 100 having an outer surface, the dimension of the inner element 100 relative to the outer element 110 being such that the inner element 100 is receivable in the outer element 110;
- providing a seal sleeve 10 according to any one of claims 1-18;
- applying the seal sleeve 10 over the inner element 100;
- fixing the seal sleeve 10 at a longitudinal position on the inner element 100;
- introducing the inner element 100 into the outer element 110;
- providing a liquid that induces the swelling of the swellable polymer material of the seal sleeve wall 12.

With this method the seal sleeve 10 may be applied at a desired position and an adequate sealing may be obtained both at the outer circumference of the seal sleeve 10 and the inner circumference of the seal sleeve 10. When the seal sleeve 10 is provided with a cylindrical core 18 that is rigid, the sealing at the inside of the seal sleeve 10 may be further promoted when a part 14*n* of seal sleeve wall 14 of swellable polymer material also extends at least partly along an inner surface of the cylindrical core 12.

Although illustrative embodiments of the present invention have been described above, in part with reference to the accompanying drawings, it is to be understood that the invention is not limited to these embodiments. Variations to the disclosed embodiments can be understood and effected by those skilled in the art in practicing the claimed invention, from a study of the drawings, the disclosure, and the appended claims. Reference throughout this specification to "one embodiment" or "an embodiment" means that a particular feature, structure or characteristic described in connection with the embodiment is included in at least one embodiment of the present invention. Thus, the appearances of the phrases "in one embodiment" or "in an embodiment" in various places throughout this specification are not necessarily all referring to the same embodiment. Furthermore, it is noted that particular features, structures, or characteristics of one or more embodiments may be combined in any suitable manner to form new, not explicitly described embodiments.

The invention claimed is:

1. A seal sleeve including:

a seal sleeve wall comprising a swellable polymer material having elastomeric properties so that the seal sleeve has non-swollen state and an expanded state, the seal sleeve wall having a closed circumference that extends around a central longitudinal axis and that has a certain length in the direction of the central axis;

the seal sleeve wall having a non-swollen thickness that is defined by the distance between an inner surface and an outer surface of the seal sleeve wall in the non-swollen state and having an expanded thickness that is defined by the distance between the inner surface and the outer surface of the seal sleeve wall in the expanded state; and wherein the seal sleeve wall has two end surfaces of which at least one extends in a plane that includes a first acute angle with the longitudinal axis.

2. The seal sleeve according to claim 1, wherein the first acute angle is in the range of 15°-50°.

3. The seal sleeve according to claim 1, wherein a first one of the end surfaces extends in a first plane that includes the first acute angle with the longitudinal axis and wherein a second one of the end surfaces extends in a second plane that includes a second acute angle with the longitudinal axis.

4. The seal sleeve according to claim 3, wherein the first and the second acute angle are the same so that the first and the second plane are parallel.

5. The seal sleeve according to claim 1, including:

a cylindrical core having a core wall that is stiff.

6. The seal sleeve according to claim 5, wherein the core has two core end surfaces that are defined by the core wall and that are each associated with an associated one of said two end surfaces, wherein each core end surface extends in a plane that is parallel to the plane in which the associated one of said two end surfaces extends.

7. The seal sleeve according to claim 5, wherein a part of the seal sleeve wall also extends at least partly at an inner surface of the cylindrical core.

8. The seal sleeve according to claim 1, including:

threaded holes in which bolts may be screwed to provide a connection between an inner element and the seal sleeve.

9. The seal sleeve according to claim 8, wherein each threaded hole extends along an associated screw axis that includes an acute angle with the longitudinal axis of the seal sleeve wall.

10. An assembly of a seal sleeve according to claim 1 and an inner element having an outer surface and an outer element having an inner surface, the inner element being receivable within the outer element so that a circumferential space is present that extends in a longitudinal direction and that has a radial width defined by the distance between the outer surface of the inner element and the inner surface of the outer element.

11. An assembly according to claim 10, wherein the inner element is a casing of a casing string and the outer element is a well bore hole wall.

12. An assembly according to claim 10, wherein the inner element is a production tubular and the outer element is a casing in a well bore hole.

13. An assembly according to claim 10, wherein the outer element is a housing of an apparatus and the inner element is a shaft that is mounted in the housing.

14. A seal sleeve, including:

a seal sleeve wall comprising a swellable polymer material having elastomeric properties so that the seal sleeve has non-swollen state and an expanded state, the seal sleeve wall having a closed circumference that extends around a central longitudinal axis and that has a certain length in the direction of the central axis;

the seal sleeve wall having, at a given longitudinal position, a non-swollen thickness that is defined by the distance between an inner surface and an outer surface of the seal sleeve wall in the non-swollen state and having, at a given longitudinal position, an expanded thickness that is defined by the distance between the inner surface and the outer surface of the seal sleeve wall in the expanded state; and two end surfaces that define a central reference plane, which is positioned centrally between the two end surfaces and extends perpendicularly to the central axis;

wherein the seal sleeve wall has an outer diameter that decreases in the direction of the central axis when viewed from the central reference plane to one of the end surfaces, wherein the seal sleeve wall includes a part that is tapered towards the end surface that is closest to the tapered part so that the outer diameter in the non-swollen state continuously decreases when viewed from the central reference plane in the direction of the end surface that is closest to the tapered part, wherein the at least one part of the seal sleeve wall that is tapered includes a taper angle $\phi$, which is defined by the top angle of a cone in which the tapered sleeve wall part extends, that is in the range of 3°-20°.

15. An assembly of a seal sleeve according to claim 14 and an inner element having an outer surface and an outer element having an inner surface, the inner element being receivable within the outer element so that a circumferential space is present that extends in a longitudinal direction and that has a radial width defined by the distance between the outer surface of the inner element and the inner surface of the outer element.

16. Method for applying a seal sleeve between an inner element and an outer element, the method including:

providing an outer element having a hole with an inner surface;

providing an inner element having an outer surface, the dimension of the inner element relative to the outer element being such that the inner element is receivable in the outer element;

providing a seal sleeve according to any one of claim 1-9 or 14;

applying the seal sleeve over the inner element;

fixing the seal sleeve at a longitudinal position on the inner element;

introducing the inner element into the hole of the outer element;

providing a liquid that induces the swelling of the swellable polymer material of the seal sleeve wall.

* * * * *